US008624818B2

(12) United States Patent
Brokaw et al.

(10) Patent No.: US 8,624,818 B2
(45) Date of Patent: Jan. 7, 2014

(54) APPARATUSES AND METHODS FOR REDUCING POWER IN DRIVING DISPLAY PANELS

(75) Inventors: A. Paul Brokaw, Tuscon, AZ (US); June Her, Tuscon, AZ (US); Jeffrey G. Barrow, Tuscon, AZ (US)

(73) Assignee: Integrated Device Technology, Inc., San Jose, CA (US)

( * ) Notice: Subject to any disclaimer, the term of this patent is extended or adjusted under 35 U.S.C. 154(b) by 326 days.

(21) Appl. No.: 13/040,077

(22) Filed: Mar. 3, 2011

(65) Prior Publication Data

US 2012/0223647 A1 Sep. 6, 2012

(51) Int. Cl.
*G09G 3/36* (2006.01)

(52) U.S. Cl.
USPC ..... 345/99; 345/204; 345/212

(58) Field of Classification Search
USPC ..... 345/60, 76, 79, 87–100, 204, 212
See application file for complete search history.

(56) References Cited

U.S. PATENT DOCUMENTS

| | | | | |
|---|---|---|---|---|
| 5,294,919 | A * | 3/1994 | Harju | 345/79 |
| 6,549,186 | B1 | 4/2003 | Kwon | |
| 6,999,050 | B2 | 2/2006 | Hung et al. | |
| 7,161,593 | B2 | 1/2007 | Jones et al. | |
| 7,310,079 | B2 | 12/2007 | Chen et al. | |
| 7,750,715 | B2 | 7/2010 | Hsu et al. | |
| 7,800,601 | B2 | 9/2010 | Miura | |
| 7,859,510 | B2 * | 12/2010 | Umezaki | 345/100 |
| 2002/0033806 | A1 * | 3/2002 | Vossen et al. | 345/204 |
| 2005/0134531 | A1 * | 6/2005 | Onozawa et al. | 345/60 |
| 2006/0274013 | A1 | 12/2006 | Lin et al. | |
| 2008/0062112 | A1 * | 3/2008 | Umezaki | 345/100 |
| 2008/0303773 | A1 | 12/2008 | Chen | |
| 2009/0201283 | A1 | 8/2009 | Inokuchi et al. | |

FOREIGN PATENT DOCUMENTS

EP 1 414 009 A1 4/2004

* cited by examiner

*Primary Examiner* — Tung X Le
(74) *Attorney, Agent, or Firm* — TraskBritt P.C.

(57) ABSTRACT

Energy sharing circuits and related methods are disclosed herein. A high voltage can be selectively coupled to a first source line and a low voltage can be selectively coupled to a second source line during a first time period. During a subsequent time period, a first coupling switch is activated to inductively couple the first source line to the second source line and diode block the second source line from the first source line. During a subsequent time period, the low voltage is selectively coupled to the first source line and the high voltage is selectively coupled to the second source line. During a subsequent time period, a second coupling switch is activated to inductively couple the second source line to the first source line and diode block the first source line from the second source line.

22 Claims, 5 Drawing Sheets

APPARATUSES AND METHODS FOR REDUCING POWER IN DRIVING DISPLAY PANELS

TECHNICAL FIELD

Embodiments of the present disclosure relate generally to power reduction for driving display panels and, more particularly, to apparatuses and methods related to energy sharing for signals that drive display panels.

BACKGROUND

Level shifters are often required for a Liquid Crystal Display (LCD) panel to control the voltage and charge on control lines for the LCD panel. Drivers may reverse the voltage on the control lines, which include a distributed capacitive load. In general, each control line is driven from a high power supply to a low power supply, through a switch. Since these control lines are operated at high frequency the resulting power dissipation is inconveniently large, which may result in self-heating and high power consumption.

However, since the control lines are switched in pairs, each switching to the voltage of the other control line in the pair, there is a possibility to save some of the energy by connecting the two distributed capacitances together. High voltage level shifters for LCD panels sometimes employ a technique known as "charge sharing" to reduce the amount of power required to exchange the voltages applied to the large distributed capacitances. When the capacitive load is charged, for example to a positive state, a voltage equal to the sum of a high side and a low side voltage is applied to the load capacitance.

When it is desired to reverse the polarity of the applied voltage, switches operate to connect the positive voltage to the low side and the negative voltage to the high side. This makes the load voltage reverse and requires, from a power supply, all the energy to charge the capacitance to twice the sum of the high and low voltages.

If, during a short interval, the capacitive load is disconnected from the power supplies the two ends of the capacitor may be connected together and the charge and energy made approximately zero. As a result, this "charge sharing" operation may reduce by half the energy required from the supplies when the voltages on the capacitors are reversed because the charge sharing brings the voltages part of the way toward their new voltage in the opposite direction.

FIG. 1 is a schematic diagram of a conventional charge sharing circuit. A high supply voltage (Vhigh) is coupled to a first position of a switch S1 and a third position of a switch S2. A low supply voltage (Vlow) is coupled to a third position of switch S1 and a first position of switch S2. Second positions of switches S1 and S2 are positions wherein the switches are open and not connected to either the high supply voltage or the low supply voltage. Resistor R1 represents parasitic resistance that may exist in the system. Switch S1 connects to a first capacitor C1 representing the distributed load on one control line of the LCD panel and switch S2 connects to a second capacitor C2 representing the distributed load on another control line of the LCD panel. In many systems, the other sides of capacitors C1 and C2 are connected together to a common signal (Vcommon) that may be driven to a mid-point voltage, a ground, or other suitable voltage. Switch S3 is coupled in series with resistor R1 and between the first capacitor C1 and the second capacitor C2.

In operation, if the switches S1 and S2 are in position 1, the two series capacitors, having a net value of C/2, will be charged to Vhigh−Vlow and the stored energy can be represented as:

$$(1/2)(C/2)(\text{Vhigh}-\text{Vlow})^2$$

If the switches S1 and S2 are toggled to position 3, the voltage across the capacitors will be reversed. One way to think about the result is to note that all the energy stored in capacitors C1 and C2 must be removed just to get the voltages to zero. Then the energy in capacitors C1 and C2 must be replaced with a like amount to build up the same voltage in the reverse direction. This total change in energy can be represented as:

$$(C/2)(-\text{Vhigh}+\text{Vlow})^2$$

This energy is provided by the voltage supplies Vhigh and Vlow and the power required over time can be represented as approximately:

$$(\text{Reversals per second})(C/2)(-\text{Vhigh}+\text{Vlow})^2.$$

However, if there is a time period between when the switches S1 and S2 are in position 1 and position 3, the switches S1 and S2 can be placed in position 2 where they are both open. Switch S3 can then be closed to connect the first capacitor C1 to the second capacitor C2 and they will "share" their charge such that they reach about a mid-point (minus any energy dissipated in resistor R1) between \Thigh and Vlow.

The stored energy will be switched between the capacitors C1 and C2 and will not need to come from the power supplies. Switch S3 can then be opened and the switches S1 and S2 can be placed in either position 1 or position 2 to charge capacitors C1 and C2 the rest of the way to their respective voltage levels. As a result, the system ends up with a net loss of only about half the energy required if the capacitor ends are not shorted through the resistor R1. The result of this "charge sharing" through the resistor R1 is that the energy from the supplies per reversal is cut about in half, thereby cutting the operating power by about a half.

However, energy consumption can still be high and the inventors have appreciated that there is a need to further reduce the energy required to drive LCD panels.

BRIEF SUMMARY

Embodiments discussed herein include apparatuses and methods for new energy sharing circuits that reduce power more than conventional charge sharing circuits.

An embodiment of the present invention is an energy sharing circuit including a first source line, a second source line, and an inductive coupler. The inductive coupler is configured for performing a first selective coupling of the first source line to the second source line through a first forward biased diode and an inductor connected in series. The inductive coupler is configured for performing a second selective coupling of the second source line to the first source line through a second forward biased diode and the inductor connected in series.

Another embodiment of the present invention is an energy sharing circuit including a first high switch for selectively coupling a high voltage to a first source line and a first low switch for selectively coupling a low voltage to the first source line. A second high switch selectively couples the high voltage to a second source line and a second low switch selectively couples the low voltage to the second source line. A first diode includes an anode operably coupled to the first source line and a second diode includes an anode operably coupled to the second source line. An inductor has a first side operably coupled to a cathode of the first diode and a second side operably coupled to a cathode of the second diode. A first coupling switch is configured for selectively coupling the first source line to the first side of the inductor and a second coupling switch is configured for selectively coupling the second source line to the second side of the inductor.

Another embodiment of the present invention is a method for energy sharing, which includes selectively coupling a high voltage to a first source line and selectively coupling a low voltage to a second source line. A first coupling switch is activated to inductively couple the first source line to the second source line and diode block the second source line from the first source line. The low voltage is selectively coupled to the first source line and the high voltage is selectively coupled to the second source line. A second coupling switch is activated to inductively couple the second source line to the first source line and diode block the first source line from the second source line.

Yet another embodiment of the present invention is a method for energy sharing. During a first time period, a first source line is charged to a high voltage and a second source line is charged to a low voltage. During a second time period subsequent to the first time period; energy is inductively moved from the second source line to the first source line to move the second source line to an intermediate high voltage and the first source line to an intermediate low voltage, and the second source line is blocked from returning energy to the first source line. During a third time period subsequent to the second time period, the second source line is charged to the high voltage and the first source line is charged to the low voltage. During a fourth time period subsequent to the third time period; energy is inductively moved from the first source line to the second source line to move the first source line to the intermediate high voltage and the second source line to the intermediate low voltage, and the first source line is blocked from returning charge to the second source line.

DETAILED DESCRIPTION

Figure 1:
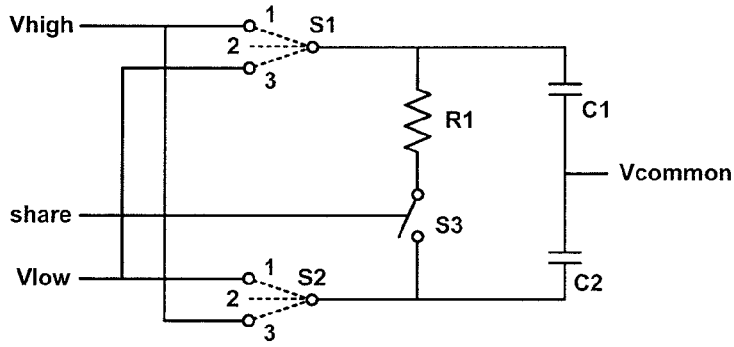
FIG. 1 is a schematic diagram of a conventional charge sharing circuit.

In the following description, elements, circuits, and functions may be shown in block diagram form in order not to obscure the present invention in unnecessary detail. Conversely, specific implementations shown and described are exemplary only and should not be construed as the only way to implement the present invention unless specified otherwise herein. Additionally, block definitions and partitioning of logic between various blocks is exemplary of a specific implementation. It will be readily apparent to one of ordinary skill in the art that the present invention may be practiced by numerous other partitioning solutions. For the most part, details concerning timing considerations and the like have been omitted where such details are not necessary to obtain a complete understanding of the present invention and are within the abilities of persons of ordinary skill in the relevant art.

Furthermore, in this description of embodiments of the invention, reference is made to the accompanying drawings which form a part hereof, and in which is shown, by way of illustration, specific embodiments in which the invention may be practiced. The embodiments are intended to describe aspects of the invention in sufficient detail to enable those skilled in the art to practice the invention. Other embodiments may be utilized and changes may be made without departing from the scope of the present invention. The following detailed description is not to be taken in a limiting sense, and the scope of the present invention is defined only by the appended claims.

Those of ordinary skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present invention may be implemented on any number of data signals including a single data signal.

The terms "assert" and "negate" may be respectively used when referring to the rendering of a signal, status bit, or similar apparatus into its logically true or logically false state. If the logically true state is a logic level one, the logically false state will be a logic level zero. Conversely, if the logically true state is a logic level zero, the logically false state will be a logic level one.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. In addition, unless stated otherwise a set of elements may comprise one or more elements.

Elements described herein may include multiple instances of the same element. These elements may be generically indicated by a numerical designator (e.g. 110) and specifically indicated by the numerical indicator followed by an alphabetic designator (e.g., 110A) or a numeric indicator preceded by a "dash" (e.g., 110-1). For ease of following the description, for the most part element number indicators begin with the number of the drawing on which the elements are introduced or most fully discussed. Thus, for example, element identifiers on a FIG. 1 will be mostly in the numerical format 1xx and elements on a FIG. 4 will be mostly in the numerical format 4xx.

When describing circuit elements, such as, for example, resistors, capacitors, and transistors, designators for the circuit elements begin with an element type designator (e.g., R, C, M) followed by a numeric indicator. Circuit element numbers may be repeated on different drawings and are not to be considered the same element unless expressly indicated as such. In other words, a capacitor C1 on FIG. 1 is a different element from a capacitor C1 on FIG. 6. Power sources such as, for example VDD and VCC as well as ground voltages may be generically indicated. When appropriate, these power signals may be described in detail. In other cases, the power signals may not be described, as it would be apparent to a person of ordinary skill in the art which power signal should be used. As a non-limiting example, it may be appropriate to maintain separate analog and digital grounds and a person of ordinary skill in the art would understand which is the appropriate ground for a specific circuit.

Embodiments discussed herein include apparatuses and methods for new energy sharing circuits that reduce power more than conventional charge sharing circuits.

Figure 2:
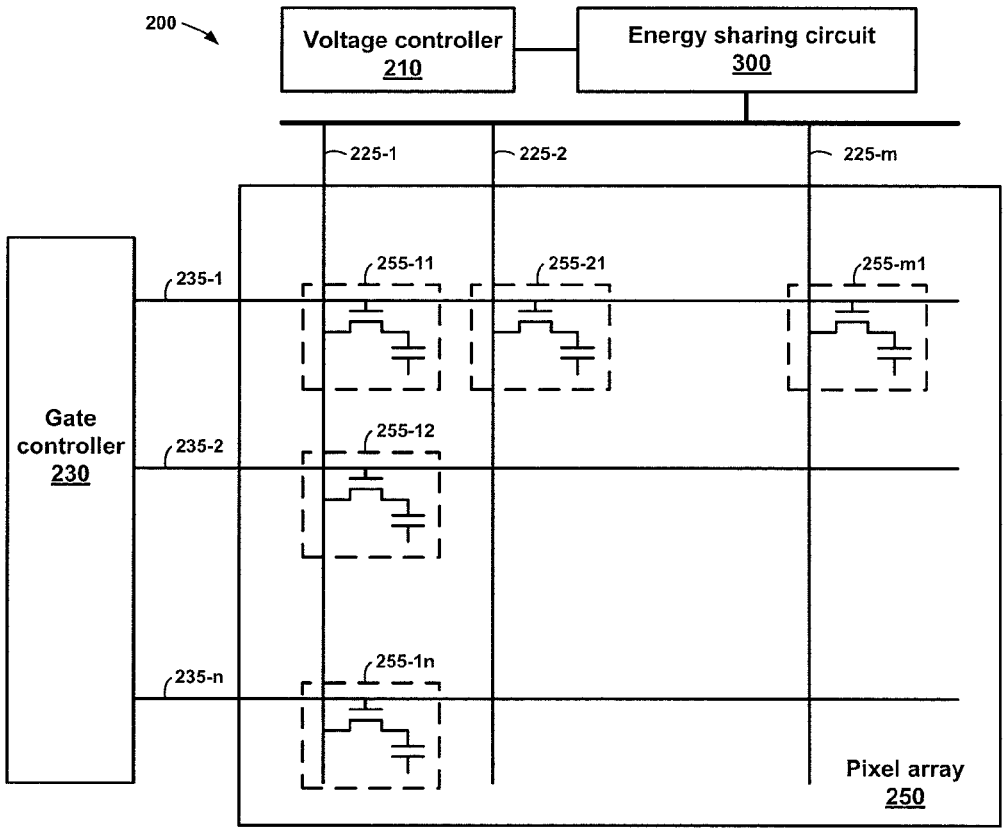
FIG. 2 is a simplified block diagram of a pixel array and controls therefor.

FIG. 2 is a simplified block diagram of an LCD panel 200 including a pixel array 250, and controls therefor. The pixel array 250 may be controlled by a gate controller 230, a voltage controller 210, and an energy sharing circuit 300. The LCD panel 200 may include additional circuits and FIG. 2 is very simplified to show the circuits and functions that may be associated with embodiments of the invention.

The pixel array 250 includes pixels 255 arranged in rows and columns. In other words, a first row includes pixels 255-11, 255-21, etc. up to "m" columns ending with pixel **255-*m*1. Similarly, a first column includes pixels 255-11, 255-12, etc. up to "n" rows ending with pixel 255-*n*1**. Each pixel may include a Metal Oxide Semiconductor (MOS) transistor for enabling the pixel and a capacitance associated with the pixel. Further details will be apparent to a person of ordinary skill in the art and need not be explained herein to describe embodiments of the present invention.

The gate controller 230 may be configured to control gate signals 235-1, 235-2 through **235-*n* to turn on the MOS transistors of various rows of the pixel array 250 at appropriate times. The energy sharing circuit 300 may be configured to place various voltages on column signals 225-1, 225-2 through 225-*m* at appropriate times as explained below. A voltage controller 210 may be included to supply any needed voltage levels to the energy sharing circuit 300. The column signals 225 couple to sources nodes of the MOS transistors in the pixel array 250 and may also be referred to herein as source lines 225. The source lines 225 may be quite long and, as a result, a considerable distributed capacitance may need to be driven by the energy sharing circuit 300**.

While referred to as rows and columns for ease of descriptions, the orientation of the pixel array 250 may be rotated such that the source lines 225 are configured as rows and the gate signals are configured as columns.

Figure 3:
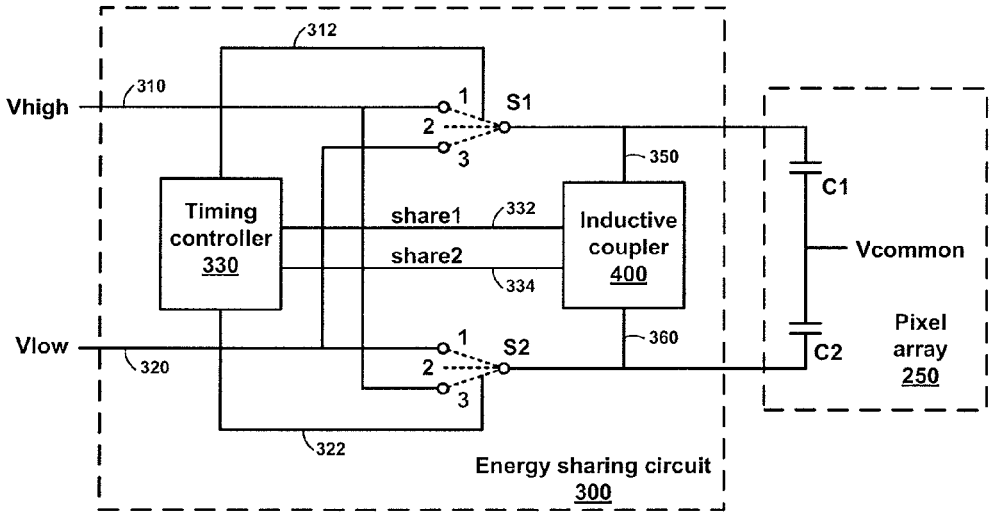
FIG. 3 is a simplified schematic diagram of an energy sharing circuit for driving source lines of a pixel array according to one or more embodiments of the invention.

FIG. 3 is a simplified schematic diagram of an energy sharing circuit 300 for driving source lines of a pixel array 250 according to one or more embodiments of the invention. Capacitor C1 represents the distributed capacitance of a first source line 350 and capacitor C2 represents the distributed capacitance of a second source line 360. In some LCD panels, the other sides of capacitors C1 and C2 may be connected together to a common signal (Vcommon) that may be driven to a midpoint voltage, a ground, or other suitable voltage.

A high supply voltage 310 (Vhigh) is coupled to a first position of a first switch S1 and a third position of a second switch S2. A low supply voltage 320 (Vlow) is coupled to a third position of the first switch S1 and a first position of the second switch S2. Second positions of switches S1 and S2 are positions in which the switches are open and not connected to either the high supply voltage 310 or the low supply voltage 320.

A timing controller 300 may be configured to control the first switch S1 via a first switch control signal 312, the second switch S2 via a second switch control signal 322, and an inductive coupler 400 via a first share signal 332 and a second share signal 334.

In operation, if the first switch S1 and the second switch S2 are in position 1, the two series capacitors C1 and C2, having a net value of C/2, will be charged to Vhigh-Vlow and the stored energy can be represented as:

$$(1/2)(C/2)(\text{Vhigh}-\text{Vlow})^2$$

If the first switch S1 and the second switch S2 are toggled to position 3, the voltage across the capacitors C1 and C2 will be reversed. One way to think about the result is to note that all the energy stored in capacitors C1 and C2 must be removed just to get the voltages to zero. Then the energy in capacitors C1 and C2 must be replaced with a like amount to build up the same voltage in the reverse direction. This total change in energy can be represented as:

$$(C/2)(-\text{Vhigh}+\text{Vlow})^2$$

However, if there is a time period between when the switches S1 and S2 are in position 1 and position 3, the switches S1 and S2 can be placed in position 2 where they are both open. At time periods when switches S1 and S2 are open (i.e., in position 2) the inductive coupler 400 can be activated to share energy between the capacitors C1 and C2.

Figure 4:
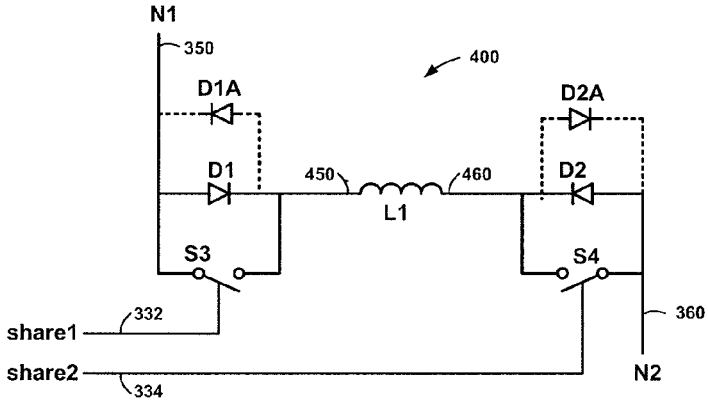
FIG. 4 is a simplified schematic diagram of an inductive coupler according to one or more embodiments of the invention.

FIG. 4 is a simplified schematic diagram of an inductive coupler 400 according to one or more embodiments of the invention. The inductive coupler 400 may be configured to selectively couple the first source line 350 and the second source line 360 to provide improved energy sharing relative to conventional charge sharing circuits.

In one direction, the first source line 350 is selectively coupled to the second source line 360 through a first diode D1, an inductor L1, and a second coupling switch S4. In another direction, the second source line 360 is selectively coupled to the first source line 350 through a second diode D2, the inductor L1, and a first coupling switch S3.

Diode D1 is connected with its cathode to a first side 450 of the inductor L1 and diode D2 is connected with its cathode on a second side 460 of the inductor L1. The first share signal 332 controls the first coupling switch S3 and the second share signal 334 controls the second coupling switch S4.

As an alternate configuration, the diodes may be biased in the opposite directions. In this alternate configuration, first diode D1A would replace first diode D1 and second diode D2A would replace second diode D2. The dashed lines indicate connections for diodes D1A and D2A in the alternate configuration. Each of the two configurations will be discussed below.

The first switch S1 (FIG. 3), the second switch S2 (FIG. 3), the first coupling switch S3, and the second coupling switch S4 may be configured as appropriate switching circuitry for carrying the voltages connected thereto. As non-limiting examples, the switches may be configured of MOS transistors such as p-channel transistors, n-channel transistors, and transmission gates. In some embodiments, the MOS transistor may be configured as high voltage transistors.

Figure 5:
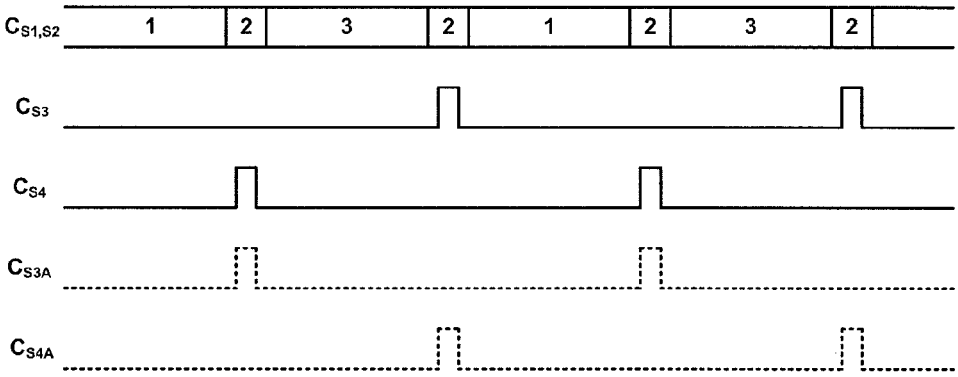
FIG. 5 is a timing diagram showing control signals for various switches of the energy sharing circuit of FIG. 3 and the inductive coupler of FIG. 4.

FIG. 5 is a timing diagram showing control signals for various switches of the timing controller 300 and inductive coupler 400. In describing the waveforms, reference will be made to FIGS. 3, 4, and 5. Waveform $C_{S1,S2}$ shows the switch positions for the first switch S1 and the second switch S2. Waveform $C_{S3}$ shows the first share signal 332 controlling the first coupling switch S3. Waveform $C_{S4}$ shows the second share signal 334 controlling the second coupling switch S4. Waveform $C_{S3A}$ shows the first share signal 332 controlling the first coupling switch S3 for the alternate configuration of FIG. 4. Waveform $C_{S4A}$ shows the second share signal 334 controlling the second coupling switch S4. For the alternate configuration of FIG. 4. In waveforms $C_{S3}$, $C_{S4}$, $C_{S3A}$, and $C_{S4A}$ a low indicates that the switch is open and a high indicates that the switch is closed.

Waveform $C_{S3A}$ and waveform $C_{S4A}$ are shown with the dashed lines to indicate the alternate configuration of FIG. 4 that includes the first and second diodes biased in the configuration illustrated as D1A and D2A.

With reference to FIGS. 3, 4, and 5, operation of the first configuration of FIG. 4 that includes the first and second diodes biased in the configuration illustrated as D1 and D2 will be discussed first.

During a first time period (may also be referred to as a first display time), the first switch S1 and the second switch S2 are in the first position as indicated by the 1 in waveform $C_{S4}$. The inductive coupler 400 is inactive with first coupling switch S3 open and second coupling switch S4 open. As a result, the first capacitor C1 will charge to the high supply voltage 310 and the second capacitor C2 will charge to the low supply voltage 320.

During a second time period (may also be referred to as a first gap time), after the first time period, the first switch S1 and the second switch S2 are in the second position as indicated by the 2 in waveform $C_{S4}$. For at least a portion of this first gap time, the second coupling switch S4 is closed as indicated by waveform $C_{S4}$. As a result, the first capacitor C1 and the second capacitor C2 are coupled together through diode D1, the inductor L1, and the second coupling switch S4. Therefore, the stored energy will be moved between the capacitors C1 and C2 and will not need to come from the power supplies.

Moreover, the inductor L1 connected across the capacitors by the second coupling switch S4 will discharge the voltage across the capacitors to a midpoint voltage (which may be zero in some embodiments) therebetween, but it will do it in an almost lossless fashion and store the energy magnetically in the inductor L1. Past the midpoint, the inductor L1 will then drive the voltages on the capacitors C1 and C2 in the same direction they were going to reverse the voltages thereon past the midpoint. Of course, there may be some losses in the inductor, switches, and any distributed resistance, which will dissipate some of the stored energy, but most of the energy stored in the inductor L1 will be used to reverse the voltage. Then, only a small voltage drive from the high supply voltage 310 and the low supply voltage 320 will be needed to restore the losses not recoverable by the inductive coupler 400. As a result, the power consumed in alternating the capacitor charge voltages will be greatly reduced.

By preserving the energy used to switch the voltages, the power input from the power supply (i.e., the high voltage source line 310 and the low voltage source line 320) may be reduced by more than an additional 60% relative to conventional charge sharing circuits. The energy lost in switch resistance may be reduced by using larger switches so that the power input may be made to approach zero.

The on time for the first coupling switch S3, during the first gap time, only needs to be long enough for the voltages to swing to their new values. The first diode D1 is in series with the inductor L1 and is forward biased during the energy sharing. As a result, if the first coupling switch S3 remains on for a longer portion of the first gap time, the first diode D1 will prevent reverse energy sharing from the second source line 360 to the first source line 350 because the first diode D1 would become reverse biased.

During a third time period (may also be referred to as a second display time), after the second gap time, the first switch S1 and the second switch S2 are in the third position as indicated by the 3 in waveform $C_{S4}$. The inductive coupler 400 is inactive with first coupling switch S3 open and second coupling switch S4 open. As a result, the second capacitor C2 will charge to the high supply voltage 310 and the first capacitor C1 will charge to the low supply voltage 320.

During a fourth time period (may also be referred to as a second gap time), after the third time period, the first switch S1 and the second switch S2 are in the second position as indicated by the 2 in waveform $C_{S4}$. For at least a portion of this second gap time, the first coupling switch S3 is closed as indicated by waveform $C_{S3}$. As a result, the second capacitor C2 and the first capacitor C1 are coupled together through diode D2, the inductor L1, and the first coupling switch S3. Therefore, the stored energy will be moved between the capacitors C2 and C1 and will not need to come from the power supplies. Operation of the inductive coupling during the second gap time is the same as explained above for the first gap time except current flows in the opposite direction through diode D2, the inductor L1, and the first coupling switch S3 rather than through diode D1, the inductor L1, and the second coupling switch S4.

After the second gap time, the timing process may repeat as long as needed with the first display time, the first gap time, the second display time, and the second gap time. During the first display time and the second display time, once the first capacitor C1 and the second capacitor C2 are fully charged to their respective voltages, the first switch S1 and second switch S2 may remain in their appropriate positions for an indefinite period determined by the needs of the LCD panel.

With reference to FIGS. 3, 4, and 5, operation of the alternate configuration of FIG. 4 that includes the first and second diodes biased in the configuration illustrated as D1A and D2A is now considered.

The first time periods (e.g., first display times) and control of the first switch S1 and the second switch S2 are the same as in the first configuration as indicated by the 1 in waveform $C_{S4}$. Similarly, the third time periods (e.g., second display times) and control of the first switch S1 and the second switch S2 are the same as in the first configuration as indicated by the 3 in waveform $C_{S4}$.

In the alternate configuration, during the second time period (i.e., first gap time), after the first time period, the first switch S1 and the second switch S2 are in the second position as indicated by the 2 in waveform $C_{S4}$. For at least a portion of this first gap time, the first coupling switch S3 is closed as indicated by waveform $C_{S3A}$. As a result, the first capacitor C1 and the second capacitor C2 are coupled together through the first coupling switch S3, the inductor L1, and second diode D2A.

In the alternate configuration, during the fourth time period (i.e., second gap time), after the third time period, the first switch S1 and the second switch S2 are in the second position as indicated by the 2 in waveform $C_{S4}$. For at least a portion of this second gap time, the second coupling switch S4 is closed as indicated by waveform $C_{S4A}$. As a result, the second capacitor C2 and the first capacitor C1 are coupled together through the second coupling switch S4, the inductor L1, and first diode D1A.

Figure 6:
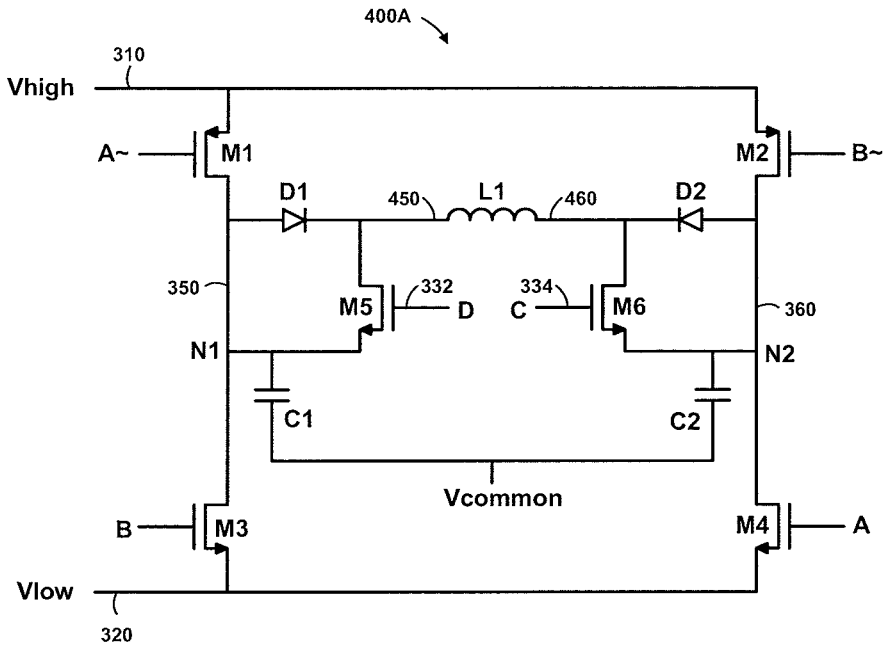
FIG. 6 is a simplified schematic diagram of switches and an inductive coupler according to one or more embodiments of the invention.

FIG. 6 is a simplified schematic diagram of switches and an inductive coupler 400A according to one or more embodiments of the invention. Devices in FIG. 6 with the same names as in FIGS. 3 and 4 perform the same functions. Namely, the first diode D1, the second diode D2, the inductor L1, and the capacitors C1 and C2 are the same. In addition, the high supply voltage 310, low supply voltage 320, and common signal (Vcommon) are also the same as in FIG. 3. FIG. 6 is illustrated as the first configuration relative to the inductive coupler portion illustrated in FIG. 4. Of course, while not illustrated a person of ordinary skill in the art would understand how to reconfigure the FIG. 6 embodiment with the alternate configuration for the inductive coupler portion illustrated in FIG. 4.

In FIG. 6, the first coupling switch S3 of FIG. 4 is embodied as an n-channel transistor M5 controlled by the first share signal 332 (also labeled as "D") and coupled between the first side 450 of the inductor L1 and the first source line 350 (also labeled as N1). The second coupling switch S4 of FIG. 4 is embodied in FIG. 6 as an n-channel transistor M6 controlled by the second share signal 334 (also labeled as "C") and coupled between the second side 460 of the inductor L1 and the second source line 360 (also labeled as N2).

The first switch S1 of FIG. 3 is embodied in FIG. 6 as a first p-channel transistor M1 (also referred to as a first high switch) and a first n-channel transistor M3 (also referred to as a first low switch). Similarly, the second switch S2 of FIG. 3 is embodied in FIG. 6 as a second p-channel transistor M2 (also referred to as a second high switch) and a second n-channel transistor M4 (also referred to as a second low switch).

Figure 7:
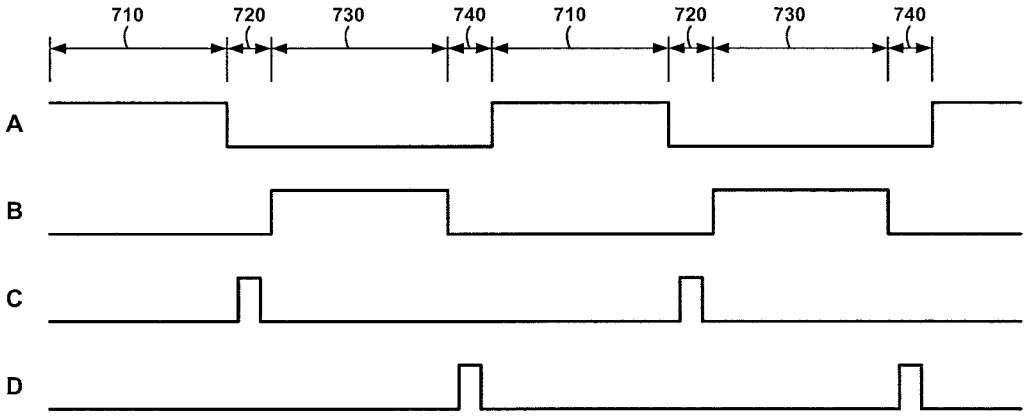
FIG. 7 is a timing diagram showing control signals for various switches of the embodiment of FIG. 6.

As example embodiments, transistors M1 and M2 are shown as p-channel transistors and transistors M3, M4, M5, and M6 are shown as n-channel transistors. However, in other embodiments, the various transistors may be configured with any appropriate switching circuitry for carrying the voltages connected thereto. As non-limiting examples, the various transistors may be configured as p-channel transistors, as n-channel transistors, and as transmission gates. In some embodiments, the transistor may be configured as high voltage transistors FIG. 7 is a timing diagram showing control signals for various switches of the embodiment of FIG. 6. FIG. 7 is similar to FIG. 5 except rather than depicting switch positions as in FIG. 5, FIG. 7 depicts control signal A and control signal B. In addition, in FIG. 7, control signal D is similar to $C_{S3}$ in FIG. 5 and control signal C is similar to $C_{S4}$ in FIG. 5. In FIG. 7, the first display time 710, the first gap time 720, the second display time 730, and the second gap time 740 are also shown.

Figure 8:
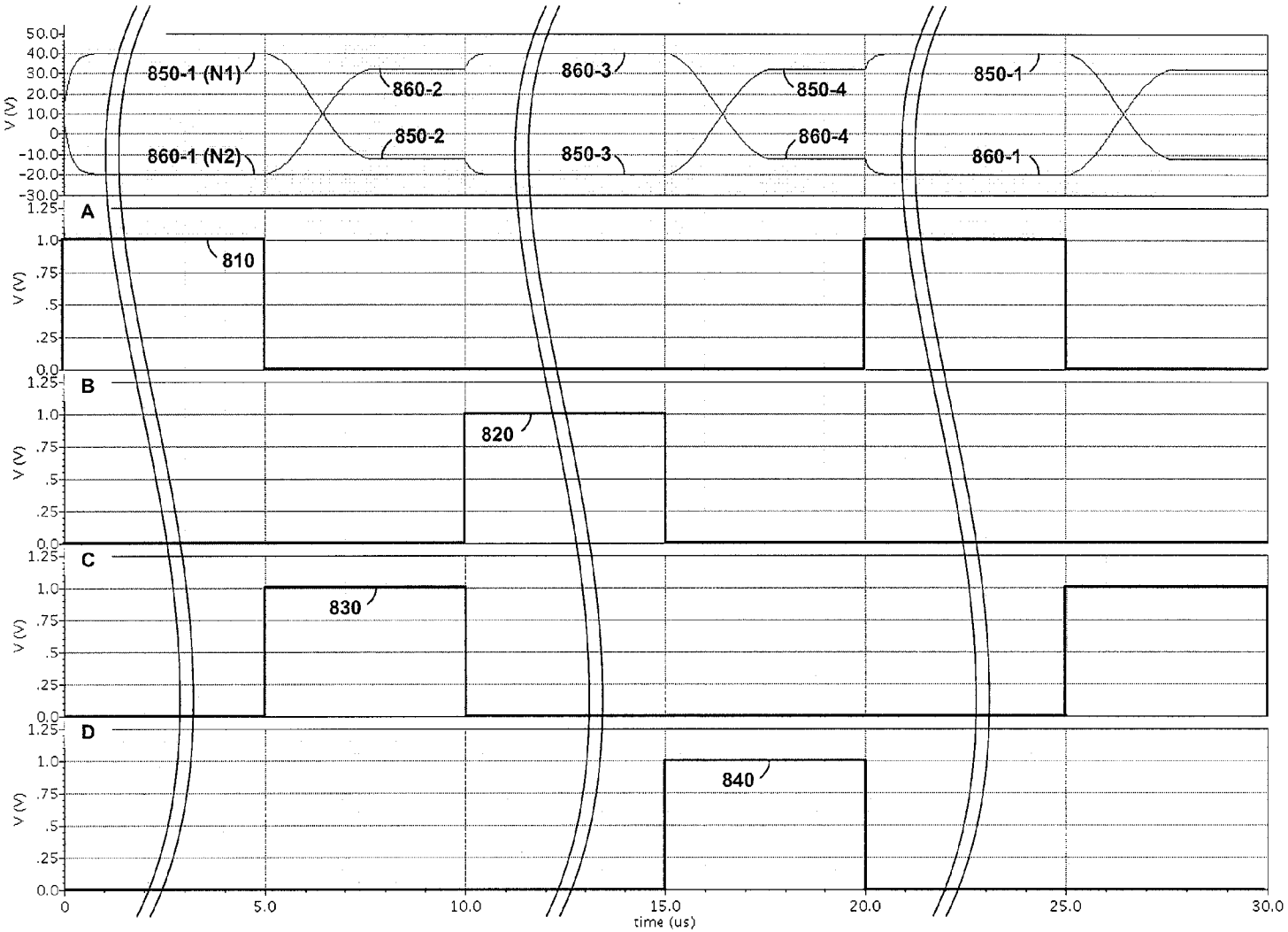
FIG. 8 is a timing diagram showing output signals and control signals for various switches of the embodiment of FIG. 6.

FIG. 8 is a timing diagram showing output waveforms (850 and 860) and control signals (A, B, C, and D) for various switches of the embodiment of FIG. 6. FIG. 8 is similar to FIG. 7 except the voltages for node N1 are included and shown as waveform 850 and the voltages for node N2 are included and shown as waveform 860. In addition, the first display time and second display time are shortened (indicated by wavy disconnect lines) and the first gap time and second gap time are expanded. Finally, FIG. 8 illustrates that the control signals C and D encompass the entire first gap time and entire second gap time, respectively.

Operation of the embodiment of FIG. 6 is discussed with reference to FIGS. 6, 7, and 8. When signal A is asserted (i.e., A is high and A~ is low) during the first display time 710, the first high switch M1 will conduct to pull node N1 to the high supply voltage 310 and the second low switch M4 will conduct to pull node N2 to the low supply voltage 320. Waveform segment 850-1 shows node N1 charging to the high voltage and waveform segment 860-1 shows node N2 charging to the low voltage.

During the first gap time 720, transistors M1, M2, M3, and M4 are all off because signal A is negated and signal B is negated. When signal C is asserted, the second coupling switch M6 conducts causing the total voltage of the two supplies (Vhigh and Vlow), minus a diode drop across diode D1, loss in the inductor L1, and any switch resistance effect in transistor M6, to appear across the inductor L1. The resulting current will pull node N1 low while pulling node N2 high. Waveform segment 850-2 shows node N1 discharging to an intermediate low voltage and waveform segment 860-2 shows node N2 charging to an intermediate high voltage.

Ideally, with no resistive losses or diode losses, the voltages at nodes N1 and N2 would reverse exactly as the current in inductor L1 falls to zero and the voltage across it is allowed to go to zero by reversing the voltage across the diode D1. Although the ideal is a complete exchange of voltages between nodes N1 and N2, the losses of switch and inductor resistance, and the diode drop will prevent complete reversal. However, the intermediate high voltage and intermediate low voltage reached in embodiments of the present invention are still a significant improvement over conventional charge sharing techniques wherein nodes N1 and N2 would only reach a midpoint between the high voltage and the low voltage.

For a complete energy reversal, an asserted time for node C should be at least as long as the time the inductor L1 takes to reverse the voltages. Once node C is negated, signal B can be asserted for the second display time 730.

When signal B is asserted (i.e., B is high and B~ is low) during the second display time 730, the second high switch M2 will conduct to pull node N2 the rest of the way from the intermediate high voltage to the high voltage as indicated by waveform segment 860-3. In addition, with signal B asserted, the first low switch M3 will conduct to pull node N1 the rest of the way from the intermediate low voltage to the low voltage as indicated by waveform segment 850-3.

When the voltages need to reverse again, signal B can be negated to enter the second gap time 740. During the second gap time 740, transistors M1, M2, M3, and M4 are all off because signal A is negated and signal B is negated. When signal D is asserted, the first coupling switch M5 conducts causing the total voltage of the two supplies (Vhigh and Vlow), minus a diode drop across diode D2, loss in the inductor L1, and any switch resistance effect in transistor M5, to appear across the inductor L1. The resulting current will pull node N2 low while pulling node N1 high. Waveform segment 850-4 shows node N1 charging to the intermediate high voltage and waveform segment 860-4 shows node N2 discharging to the intermediate high voltage. After allowing sufficient time for the current in the inductor L1 to again fall to zero, signal D can be negated, and signal A can be asserted to begin the process again with another first display time 710. The voltages on nodes N1 and N2 can be reversed in alternation for an entire LCD row (or column depending on the pixel array 250 (FIG. 2) configuration) with each voltage reversal powered in part by energy stored and released from the inductor L1.

In practice, there are losses associated with switching the inductor into place, and from losses in the inductor, so that not all the stored energy can be recovered. These losses may be compensated by driving the capacitors to the correct voltages using switches to a power supply voltage. Losses may be reduced, for example, by using low resistance switches and inductors, which enable the required external drive power to approach a theoretical limit near zero.

Figure 9:
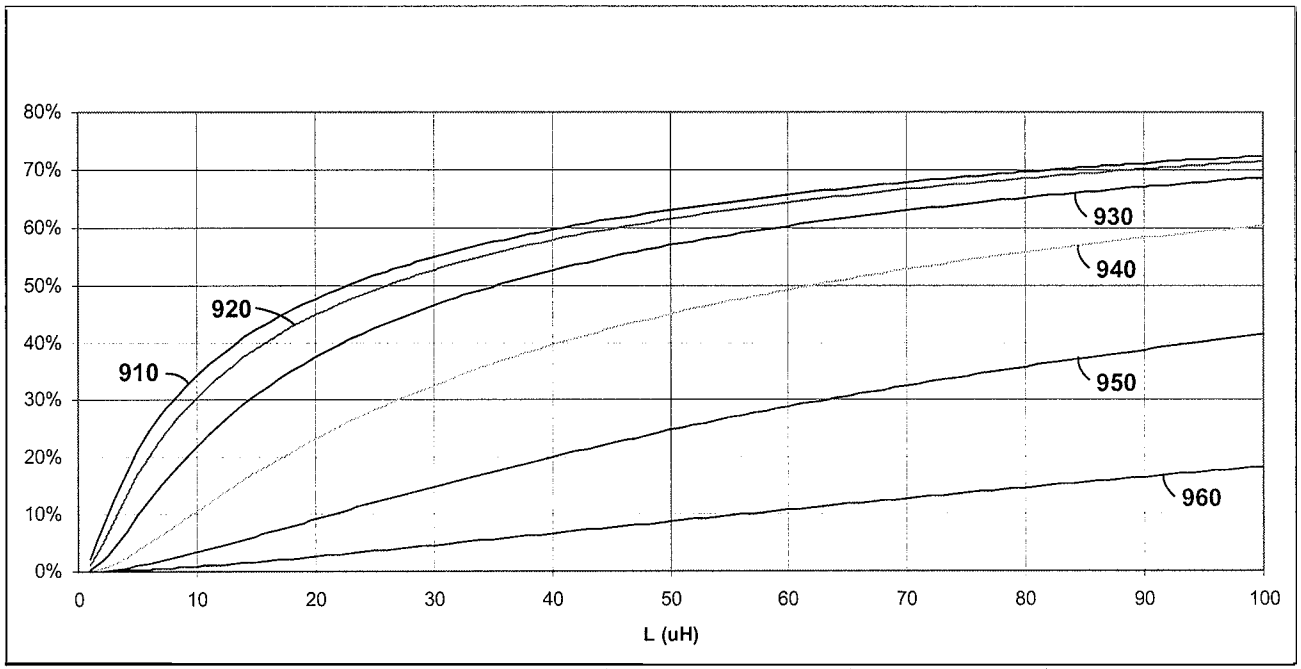
FIG. 9 is a graph showing energy saving improvements for embodiments of the invention relative to the conventional circuit of FIG. 1.

FIG. 9 is a graph showing energy saving improvements for embodiments of the invention relative to the conventional circuit of FIG. 1. Referring to FIG. 6, there may be distributed resistance (not shown) due to routing, such as, for example, between the first coupling switch M5 and the capacitor C1 (which may be a distributed capacitance). Similarly, there may be distributed resistance (not shown) due to routing, such as, for example, between the second coupling switch M6 and the capacitor C2 (which may be a distributed capacitance). The values for resistance used in the graphs of FIG. 9 may include, for example, values from routing resistance, diode resistance, inductor resistance, and switch resistance. The graphs of FIG. 9 illustrate simulations of the embodiment of FIG. 6 with the capacitors C1 and C2 each having a capacitance of 5 nanoFarads and various values for resistance relative to the embodiment of FIG. 1 with the same values for resistance and capacitance. In other words, the graphs show a percentage improvement for energy sharing in an embodiment of the invention relative to charge sharing in the conventional circuit of FIG. 1.

Line 910 shows a percentage improvement for a resistance of 10 ohms. Line 920 shows a percentage improvement for a resistance of 20 ohms. Line 930 shows a percentage improvement for a resistance of 40 ohms. Line 940 shows a percentage improvement for a resistance of 80 ohms. Line 950 shows a percentage improvement for a resistance of 160 ohms. Line 960 shows a percentage improvement for a resistance of 320 ohms. As can be seen, even with a high resistance of 320 ohms, there is about a 20% improvement and with a relatively low resistance of 10 ohms, there is over a 70% improvement.

While the present invention has been described herein with respect to certain illustrated embodiments, those of ordinary skill in the art will recognize and appreciate that the present invention is not so limited. Rather, many additions, deletions, and modifications to the illustrated and described embodiments may be made without departing from the scope of the invention as hereinafter claimed along with their legal equivalents. In addition, features from one embodiment may be combined with features of another embodiment while still being encompassed within the scope of the invention as contemplated by the inventor.

What is claimed is:

1. An energy sharing circuit, comprising:
a first source line;
a second source line;
an inductive coupler configured for performing:
a first selective coupling of the first source line to the second source line through a first forward biased diode and an inductor connected in series; and
a second selective coupling the second source line to the first source line through a second forward biased diode and the inductor connected in series; and
a timing controller configured to:
cause the first selective coupling during a first gap time between a first display time and a second display time; and
cause the second selective coupling during a second gap time between the second display time and the first display time.

2. The energy sharing circuit of claim 1, wherein:
the first selective coupling uses a first switch to couple devices in series in an order of the first forward biased diode, the inductor, and the first switch; and
the second selective coupling uses a second switch to couple devices in series in an order of the second forward biased diode, the inductor, and the second switch.

3. The energy sharing circuit of claim 1, wherein:
the first selective coupling uses a first switch to couple devices in series in an order of the first switch, the inductor, and the first forward biased diode; and
the second selective coupling uses a second switch to couple devices in series in an order of the second switch, the inductor, and the second forward biased diode.

4. The energy sharing circuit of claim 1, further comprising:
a first switch for selectively coupling, a first open, a low voltage, or a high voltage to the first source line; and
a second switch for selectively coupling a second open, the low voltage, or the high voltage to the second source line.

5. The energy sharing circuit of claim 4, wherein the timing controller is further configured to:
couple the first switch to the high voltage and the second switch to the low voltage during the first display time; and
couple the first switch to the low voltage and the second switch to the high voltage during the second display time.

6. The energy sharing circuit of claim 4, wherein:
the first switch comprises:
at least one first MOS device operably coupled between the high voltage and the first source line; and
at least one second MOS device operably coupled between the low voltage and the first source line; and
the second switch comprises:
at least one third MOS device operably coupled between the high voltage and the second source line; and
at least one fourth MOS device operably coupled between the low voltage and the second source line.

7. The energy sharing circuit of claim 6, wherein a first coupling switch is configured to perform the first selective coupling and a second coupling switch is configured to perform the second selective coupling, and further comprising a timing controller configured to:
turn on the at least one first MOS device and the at least one second MOS device during a first display time;
turn on the at least one third MOS device and the at least one fourth MOS device during a second display time;
turn on the first coupling switch during a first gap time between the first display time and the second display time; and
turn on the second coupling switch during a second gap time between the second display time and the first display time.

8. The energy sharing circuit of claim 4, wherein:
the first source line comprises a first plurality of pixels in a first line, each pixel of the first plurality comprising an access transistor with a source operably coupled to the first source line; and
the second source line comprises a second plurality of pixels in a second line, each pixel of the first plurality comprising an access transistor with a source operably coupled to the second source line.

9. An energy sharing circuit, comprising:
a first high switch for selectively coupling a high voltage to a first source line;
a first low switch for selectively coupling a low voltage to the first source line;
a second high switch for selectively coupling the high voltage to a second source line;

a second low switch for selectively coupling the low voltage to the second source line;

a first diode with an anode operably coupled to the first source line;

a second diode with an anode operably coupled to the second source line;

an inductor with a first side operably coupled to a cathode of the first diode and a second side operably coupled to a cathode of the second diode;

a first coupling switch for selectively coupling the first source line to the first side of the inductor; and a second coupling switch for selectively coupling the second source line to the second side of the inductor.

10. The energy sharing circuit of claim 9, further comprising a timing controller configured to:

close the first high switch and the second low switch during a first display time;

close the first low switch and the second high switch during a second display time;

close the first coupling switch for a first gap time between the first display time and the second display time; and close the second coupling switch for a second gap time between the second display time and the first display time.

11. The energy sharing circuit of claim 9, wherein each of the first high switch and the second high switch comprise a MOS circuit selected from the group consisting of a p-channel transistor, an n-channel transistor, and a transmission gate.

12. The energy sharing circuit of claim 9, wherein each of the first low switch and the second low switch comprise a MOS circuit selected from the group consisting of a p-channel transistor, an n-channel transistor, and a transmission gate.

13. The energy sharing circuit of claim 9, wherein each of the first coupling switch and the second coupling switch comprise a MOS circuit selected from the group consisting of a p-channel transistor, an n-channel transistor, and a transmission gate.

14. The energy sharing circuit of claim 9, wherein:

the first source line comprises a first plurality of pixels in a first line, each pixel of the first plurality comprising an access transistor with a source operably coupled to the first source line; and the second source line comprises a second plurality of pixels in a second line, each pixel of the first plurality comprising an access transistor with a source operably coupled to the second source line.

15. A method for energy sharing, comprising:

selectively coupling a high voltage to a first source line and selectively coupling a low voltage to a second source line during a first display time;

activating a first coupling switch to inductively couple the first source line to the second source line and diode block the second source line from the first source line;

selectively coupling the low voltage to the first source line and selectively coupling the high voltage to the second source line during a second display time; and activating a second coupling switch to inductively couple the second source line to the first source line and diode block the first source line from the second source wherein:

the activating the first coupling switch occurs during a first gap time between the first display time and the second display time; and the activating the second coupling switch occurs during a second gap time between the second display time and the first display time.

16. The method of claim 15, further comprising:

charging and discharging source nodes of access transistors in a first plurality of pixels in a first line coupled to the first source line; and charging and discharging source nodes of access transistors in a second plurality of pixels in a second line coupled to the first source line.

17. The method of claim 15, wherein:

activating the first coupling switch charges the second source line to an intermediate high voltage higher than a midpoint between the high voltage and the low voltage and charges the first source line to an intermediate low voltage lower than the midpoint; and activating the second coupling switch charges the first source line to the intermediate high voltage and charges the second source line to the intermediate low voltage.

18. A method for energy sharing, comprising:

during a first time period, charging a first source line to a high voltage and charging a second source line to a low voltage;

during a second time period subsequent to the first time period:

inductively moving charge from the second source line to the first source line to move the second source line to an intermediate high voltage and the first source line to an intermediate low voltage; and blocking the second source line from returning charge to the first source line;

during a third time period subsequent to the second time period, charging the second source line to the high voltage and charging the first source line to the low voltage; and during a fourth time period subsequent to the third time period:

inductively moving charge from the first source line to the second source line to move the first source line to the intermediate high voltage and the second source line to the intermediate low voltage; and blocking the first source line from returning charge to the second source line.

19. The method of claim 18, wherein:

blocking the second source line from returning charge to the first source line comprises biasing a first diode to conduct from the first source line load to the second source line load; and blocking the first source line from returning charge to the second source line comprises biasing a second diode to conduct from the second source line load to the first source line load.

20. The method of claim 18, wherein:

inductively moving charge from the first source line comprises switchably coupling a first series diode and an inductor between the first source line and the second source line; and inductively moving charge from the second source line comprises switchably coupling a second series diode and the inductor between the second source line and the first source line.

21. The method of claim 18, wherein:

charging and discharging the first source line comprises charging and discharging source nodes of access transistors in a first plurality of pixels in a first line; and charging and discharging the second source line comprises charging and discharging source nodes of access transistors in a second plurality of pixels in a second line.

22. The method of claim 18, wherein:

the intermediate high voltage is higher than a midpoint between the high voltage and the low voltage; and the intermediate low voltage lower than the midpoint.

* * * * *